United States Patent [19]

King et al.

[11] Patent Number: 4,929,283

[45] Date of Patent: May 29, 1990

[54] VAPOR PHASE ARTIFICIAL AGING OF METAL ALLOYS USING FLUOROCHEMICALS

[75] Inventors: John C. W. King, Orefield; Donald J. Bowe, Allentown; Paul T. Kilhefiner, III, Wescosville, all of Pa.

[73] Assignee: Air Products and Chemicals, Inc., Allentown, Pa.

[21] Appl. No.: 404,160

[22] Filed: Sep. 7, 1989

Related U.S. Application Data

[63] Continuation-in-part of Ser. No. 320,199, Mar. 7, 1989, abandoned.

[51] Int. Cl.[5] ..... C22F 1/02

[52] U.S. Cl. ..... 148/13.2; 148/20.3

[58] Field of Search ..... 148/13.2, 20.3, 159, 148/160

[56] References Cited

U.S. PATENT DOCUMENTS

| | | | |
|---|---|---|---|
| 2,459,780 | 1/1949 | McBee et al. | 260/648 |
| 4,549,686 | 10/1985 | Sargent et al. | 228/242 |

FOREIGN PATENT DOCUMENTS

| | | | |
|---|---|---|---|
| 2110204 | 6/1983 | United Kingdom | 23/10 |
| 2194231 | 3/1988 | United Kingdom | 23/18 |

OTHER PUBLICATIONS

Kirk-Othmer Encyclopedia of Chemical Technology; 3rd Ed.; vol. 2; 1978; pp. 177–178.

Principles of Materials, Science and Engineering; W. Smith; McGraw-Hill; New York; 1986; Ch. 9; pp. 478–479 and 490–491.

Metals Handbook, Desktop Edition by Howrad E. Boyer and Timothy L. Gall; American Society for Metals; Metals Park, OH; Ch. OA Aluminum, pp. 6–8, 6–10, 6–23.

Structure and Properties of Engineering Materials; Brick, Perse, and Gordon; McGraw-Hill; 1977; Ch. OA Aluminum Alloys; pp. 187–188, 191–193.

Tetrahedron; 1963; vol. 19; pp. 1893 and 1899; Polycyclic Fluoroaromatic Compounds-111; Harrison et al.

*Primary Examiner*—R. Dean

*Attorney, Agent, or Firm*—Geoffrey L. Chase; James C. Simmons; William F. Marsh

[57] ABSTRACT

Artificial aging of metal alloys in the process of precipitation hardening is performed in the elevated temperature vapor of a perfluorochemical to reduce temperature fluctuations, preserve alloy integrity and avoid environmentally detrimental process conditions and by-products.

20 Claims, No Drawings

VAPOR PHASE ARTIFICIAL AGING OF METAL ALLOYS USING FLUOROCHEMICALS

The present invention is a continuation-in-part of Ser. No. 07/320,199 filed March 7, 1989 abandoned.

TECHNICAL FIELD

The present invention is directed to the field of precipitation strengthening of alloys. More specifically, the present invention is directed to improvements in the third step of precipitation hardening, which involves (1) solution heat treatment, (2) quenching and (3) artificial aging.

BACKGROUND OF THE PRIOR ART

Precipitation treatment of alloys, such as aluminum alloys, is well known in the prior art as identified for aluminum alloy 6061 and aluminum alloy 2024 in Kirk-Othmer Encyclopedia of Chemical Technology. Third Edition Volume 2, 1978, page 177–178. The recited aging treatment is "natural aging", due to its processing at essentially ambient temperatures.

As set forth in Principles of Materials. Science and Engineering. W. Smith, McGraw-Hill, New York, 1986. Chapter 9, page 478–479and 490–491, precipitation strengthening or hardening is known to create a heat treated alloy of dense and fine dispersion of precipitated particles in the matrix of deformable metal. The precipitate particles act as obstacles to dislocation movement and thereby strengthen the heat treated alloy. The treatment is known to include a solution heat treatment to create a uniform solid solution structure. The alloy is then quenched, typically with cooling water, to room temperature to produce a super saturated solid solution. Finally, the alloy is aged either by "natural aging" at ambient temperatures or "artificial aging" at elevated temperatures to form finely dispersed precipitates. These fine precipitates in the alloy impede dislocation movement during deformation by forcing the dislocations to either cut through the precipitate particle or go around them, thereby strengthening the alloy. Alloys susceptible to such treatment include the wrought and forged aluminum alloys designated: 2XXX, 6XXX, and 7XXX and the cast aluminum alloys designated: 2XX, 3XX and 7XX. The 2XXX alloy is aluminum principally alloyed with copper. The 6XXX alloy aluminum is principally alloyed with magnesium and silicon. The 7XXX aluminum alloy is principally alloyed with zinc, magnesium and copper. The 2XX cast aluminum alloy is principally alloyed with copper. The 3XX cast aluminum alloy is principally alloyed with silicon and copper or silicon and magnesium or silicon and magnesium and copper. The 7XX cast aluminum alloy is principally alloyed with zinc, magnesium and copper.

These designations for cast and wrought aluminum and aluminum alloys are well known in the art, such as in Metals Handbook, desktop edition by Howard E. Boyer and Timothy L. Gall, American Society for Metals. Metals Park, OH, Chapter on Aluminum, 6–8 through 6–10 and 6–23.

The designation to 2XXX, 6XXX and 7XXX for wrought and forged alloys and 2XX. 3XX and 7XX for cast alloys is further demonstrated to be a well recognized nomenclature in the prior art by reference to Structure and Properties of Engineering Materials, Brick, Perse and Gordon, McGraw-Hill, 1977, Chapter on Aluminum Alloys, Page 187 and 188 and Pages 191 through 193.

Various fluorocarbons are known in the prior art, such as those recited in U.S. Pat. No. 2,459,780 which describes the heat transfer capabilities of fully fluorinated and fully saturated carbon compounds.

These compounds are additionally disclosed in Tetrahedron, 1963 Volume 19, page 1893 and 1899. and in an article entitled "Polycyclic Fluoro Aromatic Compounds III", Harrison, et al.

The use of heating solder for vapor phase soldering using fluorocarbons has been disclosed in U.K. patent application GP2110204A.

Additional fluorocarbons useful for vapor phase soldering are identified in U.K patent application GP2194231A.

The use of perfluorotetradecahydrophenanthrene has been set forth in U.S. patent 4,549,686.

The artificial aging of alloys is currently performed in two types of furnaces, either a salt bath or an air chamber furnace. Both of these furnaces have inherent problems. Air furnaces suffer from poor temperature uniformity, while salt bath furnaces create environmental, waste disposal and safety concerns. There exists a need to provide a process for the artificial aging of alloy parts that will overcome these present problems.

More particularly, temperature variations, particularly with air chamber furnaces can lead to overage parts that are either reheat treated or scrapped due to unacceptable physical properties. Military specification MIL-I-6088F and Pratt & Whitney specification PWA-11AK specify a maximum temperature deviation of 10° F. from set point, which can be difficult to achieve with this type of furnace.

Additionally, parts treated in salt baths can entrap sodium nitrate salts from the aging heat treatment. The entrapped salt can react with quench water to form compounds that attack the alloys being treated. Salt entrapment after the alloy parts are removed from the salt bath requires another processing step for the entrapped salts removal, thereby decreasing productivity and increasing production cost.

There are ever growing environmental concerns about the salts used in salt bath furnaces. The disposal of used salts is becoming increasingly more difficult and expensive. Salt bath furnaces are a safety and environmental problem in the work place when water comes into contact with the molten salt which can cause explosions. Finally, the vapors given off from salt baths are often toxic.

In order to overcome the disadvantages in the artificial aging of alloys at elevated temperatures, it is necessary to provide a consistently uniform heat source that is inert to the treated alloy, economical in supply and not subject to degradation, particularly to toxic by-products, and not susceptible to environmentally difficult disposal. The present invention achieves all of these goals by overcoming the disadvantages of the prior art recited above. The present invention will be set forth below in detail.

BRIEF SUMMARY OF THE INVENTION

The present invention is a process for the artificial aging at elevated temperatures of metal alloys to impart precipitation hardening, wherein the improvement comprises aging the alloy in the elevated temperature vapor of a fluorochemical compound.

Preferably, the alloy has initially been solution heat treated and quenched.

Preferably, the alloy is selected from the group consisting of aluminum alloys and beryllium copper alloys.

Preferably, the fluorochemical is a perfluorocarbon.

Preferably, the perfluorocarbon is selected from the group consisting of perfluorodecalin, perfluoromethyldecalin, perfluorodimethyldecalin, perfluoroisopropyldecalin, perfluorotetradecahydrophenanthrene, perfluorodiisopropyldecalin and perfluoro-1,1-bis(3,4 dimethylcyclohexyl) ethane.

Preferably, the alloy is selected from the group of wrought and forged alloys consisting of 2XXX aluminum alloys, 6XXX aluminum alloys and 7XXX aluminum alloys.

Preferably, the alloy is an aluminum alloy which is alloyed with copper; magnesium and silicon; or zinc, magnesium and copper.

Preferably, the alloy is an aluminum alloy 6061 containing aluminum with 1% magnesium. 0.6% silicon and 0.2% chromium.

Preferably, the artificial aging is performed at a temperature in the range of approximately 70° C. to 300° C.

Preferably, the alloy is selected from the group consisting of 2XX, 3XX and 7XX cast aluminum alloy.

DETAILED DESCRIPTION OF THE INVENTION

Improvements in the artificial aging of precipitation hardenable metal alloys have taken the form of refinements to the current design of air chambers or salt bath furnaces. The temperature uniformity problem in air chamber furnaces has been addressed through improved furnace design. Better insulation, improved thermocouple placement, along with more sophisticated precision temperature control equipment have all been attempted without adequate success. The environmental and disposal problems with salts used in salt bath furnaces have been addressed in part by the development of less toxic salts. However, this has not eliminated the problem of explosions when water comes in contact with the molten salt utilized. Accordingly, the present invention utilizing the vapor phase heating of metal alloys for artificial aging using fluorochemicals, such as select perfluorocarbons, provides a unique and beneficial improvement to this metal treatment technique.

The term fluorochemical as used herein is defined as a compound having at least a single fluorine replacing hydrogen in a bond with the compound. Thus, fluorochemicals as used herein may include aromatic and nonaromatic hydrocarbons or corresponding heteroatom containing compounds with or without carbon, which have been at least partially fluorinated wherein at least some hydrogen is substituted with fluorine. The term perfluorocarbon as used herein, means a carbon compound which is fully fluorinated and has no unsaturation. Thus, perfluorocarbons contain carbon and fluorine without hydrogen. Because the nomenclature for this relatively new group of compounds has not been standardized and is subject to further developments, there is at least general agreement in the art that specific perfluorocarbons can be named by the nomenclature perfluoro, followed by an aromatic precursor designation. For example, perfluorophenanthrene actually is used to designate phenanthrene which has been completely deprived of hydrogen and unsaturating double bonds and comprises a fully fluorine substituted condensed ring structure of three cyclohexyl groups. Accordingly, for the purposes of this invention, the term perfluorocarbon will indicate total fluorine replacement and total saturation of any aromatic structure despite the use of aromatic nomenclature to designate the hydrocarbon precursor.

Examples of appropriate fluorochemicals that can be utilized in the present invention include, perfluorodecalin which boils at approximately 142° C. perfluoromethyldecalin which boils at approximately 160° C, perfluorodimethyldecalin which boils at approximately 180° C., perfluoroisopropyldecalin which boils at approximately 200° C., perfluorotetradecahydrophenanthrene which boils at approximately 215° C., perfluorodiisopropyldecalin which boils at approximately 240° C., perfluoro-1,1-bis(3,4 dimethylcyclohexyl) ethane, which boils at approximately 260° C., perfluorotributylamine. perfluorotripentylamine, perfluorotrihexylamine, perfluorotripropylamine, perfluoropolyethers having repeating units such as: $—(CF_2—CF(CF_3)O)_n—$; $—(CF_2—CF_2\text{-}O)_n(\text{-}CF_2O)_m$; and $—(CF_2—CF_2—CF_2—O)_n$ where n is selected for an appropriate temperature range of the compounds boiling point, but can be 2–400.

The physical properties of perfluorocarbon fluids make them an ideal fit for the artificial aging of metal alloys. These fluids have tight boiling points and high thermal stability in the desired approximately 70° to 300° C. artificial aging range. The fluids are able to provide a uniform temperature for vapor phase heating. The fluids are classified as nonhazardous, and they do not provide any significant environmental concerns in the workplace. The artificial aging temperature can be varied by selecting the appropriate perfluorinated fluid or mixtures thereof. The required aging times and temperatures are specified by the applicable specification for the appropriate alloy.

The vapor phase process of the present invention differs from the prior art practice of artificial aging, in that it uses a fluorochemical vapor to heat the alloy instead of a liquid with a salt bath or air with a direct fired air chamber furnace.

The artificial aging of the present invention is performed by heating the alloy in the condensing vapor produced from boiling the specified fluorochemical compound. As the fluorochemical compound boils at its designated boiling point in an appropriate containment device, a constant elevated temperature vapor of the fluorochemical forms above the boiling liquid. Condensing coils positioned above a workspace in the containment device keep the vapor restrained and returns vapor by condensation to the liquid. The condensing coil can be powered by appropriate refrigeration or cooling water. A relatively lower temperature part or alloy to be artifically aged is placed into the workspace of the containment device to be enveloped in the vapor of the boiling fluorochemical compound. The vapor condenses on the cooler alloy and imports its heat of condensation to the alloy, thus heating it to accomplish the artificial aging.

The fluorochemical compound can be only a component of the vapor, but preferably is at least a significant component of the vapor. More preferably, the fluorchemical compound is a predominant component of the vapor. Optimally, the vapor consists essentially of the fluorochemical compound. Most optimally the vapor consists entirely of said fluorochemical compound.

The alloys treatable by the present invention include most preferably the wrought and forged aluminum alloys such as those designated 2011, 2014, 2017, 2117, 2218, 2618, 2219, 2419, 2024, 2124, 2224, 2025, 2036 4032, 6101, 6201, 6009, 6010, 6151, 6351, 6951, 6053, 6061, 6262, 6063. 6066, 6070, 7001, 7005, 7016, 7021, 7029, 7049, 7050, 7150, 7075, 7175(b), 7475, 7076, 7178, and other appropriate alloys of similar designation. These aluminum alloys generally include designation 2XXX, 6XXX and 7XXX. The cast alloys treatable by the present invention include most preferably the cast aluminum alloys, such as those designated 222, 242, 295, 296, 319, 336, 355, 356 and 712. Of particular interest is the aluminum alloy 6061 which comprises aluminum alloy with 1.0% magnesium, 0.6% silicon and 0.2% chromium. The precipitation strengthening, of which the artificial aging of the present invention is a substep, is designed to heat treat alloys to provide a dense and fine dispersion of precipitated particles in the matrix of deformable metal. The precipitate particles act as obstacles to dislocation movement and thereby strengthen the heat treated alloy. The precipitation strengthening process involves the following three basic steps:

1. Solution heat treatment is the first step in the precipitation strengthening process. Sometimes this treatment is referred to as solutionizing. The alloy sample which may be in the wrought or cast form is heated to a temperature between the solvus and the solidus temperatures and soaked there until a uniform solid solution structure is produced.
2. Quenching is the second step in the precipitation strengthening process. The alloy is rapidly cooled to a low temperature, usually room temperature, and the cooling medium is usually water at room temperature. The structure of the alloy after water quenching consists of a super saturated solid solution.
3. Aging is the third basic step in the precipitation strengthening process. Aging the solution heat treated and quenched alloy is necessary so that a finely dispersed precipitate forms. The formation of a finely dispersed precipitate in the alloy is the objective of the precipitation strengthening process. The fine precipitate in the alloy impedes dislocation movement during deformation by forcing the dislocations to either cut through the precipitated particles or go around them. By restricting dislocation movement during deformation, the alloy is strengthened. Aging the alloy at room temperature is called "natural aging", whereas aging at "elevated" temperatures is called "artificial aging". Most alloys require artificial aging and the aging temperature is usually between about 15 to 25% of the temperature difference between room temperature and the solution heat treatment temperature. The present invention is directed to artificial aging of alloys in the three step process of precipitation strengthening set forth above.

The process of the present invention will be described with reference to a example of the preferred embodiment.

EXAMPLE

The vapor phase aging of an aluminum alloy sample 6061 using the perfluorocarbon fluid of perfluorodimethyldecalin was performed in a pyrex beaker placed on an electric hotplate. Water filled cooling coils wrapped around the top of the beaker to cool and condense the vapor from the boiling perfluorinated fluid to confine the vapor in the beaker. The parts, comprising aluminum alloy 6061 to be artificially aged, were suspended in the vapor while they were being heated by the vapor phase condensation of the boiling fluid of the fluorocarbon on the parts. Approximately 250 milliliters of the perfluorodimethyldecalin was boiled at 180° C. to artificially age the 6061 alloy of aluminum. Conditions were set to meet military specification MIL-I-6088F which specifies a temperature of 171° to 182° C. to be used for 7 to 9 hours. This experiment was run at 180° C for 7 hours. The parts were supported in the center of the beaker at approximately 4 inches above the bath and 4 inches from the cooling coils. The temperature uniformity within the vapor never varied more than 1° C. from the 180° C. setpoint. By means of a thermocouple embedded in one of the parts, the temperature of one of the parts, as measured, never varied more than 1° C. from the vapor temperature of 180° C. after temperature equilibrium was achieved. The resulting hardness of the two aluminum alloy 6061 parts that were artificially aged in this example of the present invention increased from 19 and 21 Rockwell "B" Scale ($R_b$) B before aging to 55 and 58 $R_b$ respectively after aging. The results are set forth in Table 1 below.

TABLE 1

RESULTS OF ALUMINUM AGING TESTS

| | |
|---|---|
| Material | 6061 |
| Specification | MIL-I-6088F |
| Aging Cycles | 340–360° F. (171–182° C.) for 7 to 9 hours (or 310–330° F. for 17 to 19 hours) |
| Required Hardness | 42 minimum Rockwell B, aim 54 minimum |
| Fluid | perfluorodimethyldecalin with B.P. of 180° C. |

| | TEST DATA | |
|---|---|---|
| | SAMPLE A | SAMPLE B |
| $R_b$ Before Aging | 21 | 19 |
| Vapor Temperature | 180° C. | 180° C. |
| Part Temperature (embedded thermocouple) | — | 180° C. |
| Aging Time | 7 hours | 7 hours |
| $R_b$ After Aging | 58 | 55 |

The example set forth above demonstrates that vapor phase heating of aluminum alloys for artificial aging results in the appropriate hardening characteristics desired in this third step of the precipitation strengthening process. In addition, the experiment further demonstrates that an extremely uniform heating condition can be prescribed by the use of the boiling liquid creating a vapor phase which fully envelopes the alloy being treated. Finally, the appropriate use of apparatus to retain the boiling liquid and to condense the vaporizing boil-off of the fluorochemical provides a means to contain the heat treating working fluid, so as to avoid environmental concerns. The heat cycle stability of the recited fluorochemicals avoids the possibility of degradation byproducts and toxic derivatives. Accordingly, the present invention provides a unique workable alternative for artificial aging, which overcomes the temperature variations and fluctuations of the prior art air furnaces while also providing a safe non-toxic stable and inert working fluid which is far superior to the salt baths of the prior art. These attributes provide a unique enhancement over the prior art artificial aging technique for the precipitation strengthening of various metal alloys using elevated temperatures.

The present invention has been set forth with regard to several preferred components and a preferred embodiment, but the full scope of the present invention should be ascertained by the claims which follow.

We claim:

1. In a process for the artificial aging at elevated temperatures of metal alloys to impart precipitation hardening, the improvement comprising aging said alloy in the elevated temperature vapor of a fluorochemical compound.

2. The process of claim 1 wherein said alloy has initially been solution heat treated and quenched.

3. The process of claim 1 wherein said alloy is selected from the group consisting of aluminum alloys and beryllium copper alloys.

4. The process of claim 1 wherein the fluorochemical is a perfuorocarbon.

5. The process of claim 4 wherein said perfluorocarbon is selected from the group consisting of perfluorodecalin, perfluoromethyldecalin, perfluorodimethyldecalin, perfluoroisopropyldecalin, perfluorotetradecahydrophenanthrene, perfluorodiisopropyldecalin and perfluoro-1,1bis(3,4 dimethylcyclohexyl) ethane.

6. The process of claim 1 wherein said alloy is selected from the group consisting of 2xxx aluminum alloys, 6xxx aluminum alloys and 7xxx aluminum alloys.

7. The process of claim 1 wherein said alloy is an aluminum alloy with copper; magnesium and silicon; or zinc, magnesium and copper.

8. The process of claim 1 wherein the alloy is 6061 aluminum alloy.

9. The process of claim 1 wherein the artificial aging is performed at a temperature in the range of approximately 70° C. to 300° C.

10. The process of claim 1 wherein the compound is perfluorodimethyldecalin.

11. The process of claim 1 wherein said alloy is selected from the group consisting of 2XX aluminum cast alloys, 3XX aluminum cast alloys and 7XX aluminum cast alloys.

12. The process of claim 1 wherein the fluorochemical compound is a significant component of said vapor.

13. The process of claim 1 wherein the fluorochemical compound is the predominant component of said vapor.

14. The process of claim 1 wherein said vapor consists essentially of said fluorochemical compound.

15. The process of claim 1 wherein said vapor consists of said fluorochemical compound.

16. In a process for the artificial aging at elevated temperatures of metal alloys to impart precipitation hardening, the improvement comprising aging said alloy by heating it in the condensing vapor produced from boiling a fluorochemical compound.

17. The process of claim 16 wherein the fluorochemical compound is a significant component of said vapor.

18. The process of claim 16 wherein the fluorochemical compound is the predominant component of said vapor.

19. The process of claim 16 wherein said vapor consists essentially of said fluorochemical compound.

20. The process of claim 16 wherein said vapor consists of said fluorochemical compound.

* * * * *